US011857826B2

(12) United States Patent
Freig

(10) Patent No.: US 11,857,826 B2
(45) Date of Patent: Jan. 2, 2024

(54) VERSATILE WEIGHT BAR ASSEMBLY

(71) Applicant: Abraham Freig, Phoenix, AZ (US)

(72) Inventor: Abraham Freig, Phoenix, AZ (US)

( * ) Notice: Subject to any disclaimer, the term of this patent is extended or adjusted under 35 U.S.C. 154(b) by 344 days.

(21) Appl. No.: 16/516,156

(22) Filed: Jul. 18, 2019

(65) Prior Publication Data

US 2021/0016127 A1 Jan. 21, 2021
US 2021/0394008 A9 Dec. 23, 2021

Related U.S. Application Data

(60) Provisional application No. 62/700,059, filed on Jul. 18, 2018.

(51) Int. Cl.

| | |
|---|---|
| ***A63B 21/075*** | (2006.01) |
| ***A63B 21/072*** | (2006.01) |
| ***A63B 21/00*** | (2006.01) |
| ***A63B 15/00*** | (2006.01) |
| ***A63B 23/035*** | (2006.01) |

(52) U.S. Cl.
CPC ..... *A63B 21/0728* (2013.01); *A63B 15/00* (2013.01); *A63B 21/4034* (2015.10); *A63B 23/0355* (2013.01)

(58) Field of Classification Search
CPC ..... A63B 21/4034; A63B 21/078; A63B 21/0728; A63B 15/00; Y10T 403/32483
See application file for complete search history.

(56) References Cited

U.S. PATENT DOCUMENTS

| | | | | |
|---|---|---|---|---|
| 2,114,790 | A * | 4/1938 | Venables | A63B 21/4001 482/105 |
| 3,343,836 | A * | 9/1967 | James, Jr. | A63B 21/065 482/105 |
| 5,060,933 | A * | 10/1991 | Cedro | A63B 23/14 482/44 |
| 5,628,713 | A | 5/1997 | Wilkinson | |
| 7,364,536 | B2 | 4/2008 | Cappellini et al. | |
| 8,047,974 | B1 * | 11/2011 | Kanelos | A63B 21/0724 482/106 |
| 9,586,073 | B2 | 3/2017 | Walker | |
| 2011/0177922 | A1 * | 7/2011 | Selinger | A63B 21/0724 482/107 |
| 2012/0028766 | A1 | 2/2012 | Zeek | |

(Continued)

FOREIGN PATENT DOCUMENTS

| | | | |
|---|---|---|---|
| DE | 202017003916 U1 * | 10/2017 | A63B 21/0603 |
| KR | 20170050795 | 5/2017 | |

(Continued)

*Primary Examiner* — Joshua T Kennedy
(74) *Attorney, Agent, or Firm* — Chen-Chi Lin

(57) ABSTRACT

A barbell assembly includes a main bar having a pair of opposing, internally threaded ends and a central collar. A longer extension bar includes an externally threaded post at a first end and a cap at the opposing end. A weight disc with a central aperture is slidable onto either the main bar or the extension bar depending upon an exercise to be performed. The main bar and weight disc can be used independently to perform a myriad of resistance exercises somewhat similar to a conventional dumbbell. Alternatively, the threaded post on the extension bar can be secured to either end of the main bar to allow a user to perform various exercises that require an elongated implement having a weighted end.

9 Claims, 9 Drawing Sheets

(56) References Cited

U.S. PATENT DOCUMENTS

| | | | | |
|---|---|---|---|---|
| 2014/0051554 | A1* | 2/2014 | Walker | A63B 23/03525 482/109 |
| 2014/0336019 | A1 | 11/2014 | Villella | |
| 2015/0231441 | A1* | 8/2015 | Davies, III | A63B 21/4035 482/107 |
| 2017/0216654 | A1* | 8/2017 | Parker | A63B 21/0724 |
| 2018/0133538 | A1* | 5/2018 | Jones | A63B 21/0602 |

FOREIGN PATENT DOCUMENTS

| | | | | |
|---|---|---|---|---|
| KR | 20170050795 | A | * | 5/2017 |
| WO | 9309850 | | | 5/1993 |

* cited by examiner

VERSATILE WEIGHT BAR ASSEMBLY

BACKGROUND OF THE INVENTION

The present invention relates to weight bar assembly including a shorter main bar that can be used as a conventional dumbbell and extension bar that can be attached to the main bar to perform swinging exercises.

DESCRIPTION OF THE PRIOR ART

Conventional weight systems typically include a shorter dumbbell that allows a user to perform various exercises with a single hand, or a longer barbell that is designed to be used by both hands. In order to enjoy the benefits of a dumbbell and barbell, a user must purchase both, which is expensive and burdensome. Furthermore, there are a myriad of desirable exercises in which a user benefits by swinging, lifting or manipulating an elongated implement having a weighted distal end. For example, a weighted shaft allows an exerciser to simulate swinging a sledge hammer to strengthen the core, the latissimus dorsi and numerous other muscles. However, these types of exercises cannot be practically performed with either a barbell or dumbbell.

A review of the prior art reveals a few devices that are purportedly designed to overcome some of the aforementioned disadvantages associated with conventional weights. For example, U.S. Pat. No. 7,364,536 issued to Cappellini et al. discloses a weight bar including an elongated tube having two opposing internally threaded ends. A shorter dumbbell having two opposing externally threaded ends can be secured to either end of the weight bar. The device combines the features and advantages of a dumbbell and barbell into a single implement.

International patent publication no. WO9309850 to Siegfried discloses a combined long and short dumbbell including a pair of shorter segments that can be individually used as a dumbbell and an additional two segments that can be coupled with the shorter segments to form a longer barbell. The segments are joined with threaded connections.

Korean patent no. KR20170050795 discloses a weight bar including a pair of segments having externally threaded ends and a central internally threaded sleeve that can be secured to one or both of the segments to form a barbell having a desired length.

U.S. Pat. No. 5,628,713 issued to Wilkinson discloses an adjustable exercise pole.

U.S. Pat. No. 8,047,974 issued to Kanelos discloses a weight bar formed of a plurality of threaded segments, any number of which can be joined with threaded couplers to form an exercise bar having a desired length.

U.S. Pat. No. 9,586,073 issued to Walker discloses a variable-weight hammer for performing certain exercises.

U.S. patent publication no. 2012/0028766 to Zeek discloses a sandal adapted to attach to a dumbbell.

U.S. patent publication no. 2014/0336019 to Villella discloses an exercise bar formed of three attachable segments to vary the length according to a given exercise.

Although several weight assemblies with attachable bar segments exist, none include unique attachments that allow a user to perform a multitude of exercises according to the present invention.

SUMMARY OF THE INVENTION

The present invention relates a barbell assembly including a main bar having a pair of opposing, internally threaded ends and a central collar. A longer extension bar includes an externally threaded post at a first end and a cap at the opposing end. A weight disc with a central aperture is slidable onto either the main bar or extension bar depending upon an exercise to be performed. The main bar and weight disc can be used independently to perform a myriad of resistance exercises somewhat similar to a conventional dumbbell. Alternatively, the threaded post on the extension bar can be secured to either end of the main bar to allow a user to perform various exercises that require an elongated implement having a weighted end. For example, a weighted hammer attachment allows a user to swing the extension bar against a heavy bag or similar surface.

It is therefore an object of the present invention to provide a weight bar assembly that conveniently combines the features and advantages of a dumbbell and barbell.

It is therefore another object of the present invention to provide a weight bar assembly having an attachable extension bar that allows a user to perform various swinging exercises with a weighted implement.

It is yet another object of the present invention to provide a weight bar assembly having several interchangeable attachments.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
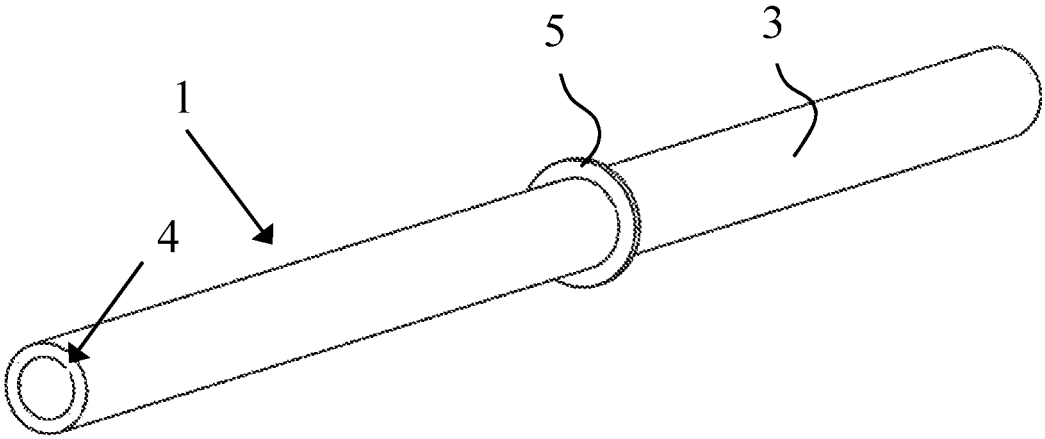
FIG. 1 is a perspective, isolated view of the main bar.
Figure 2:
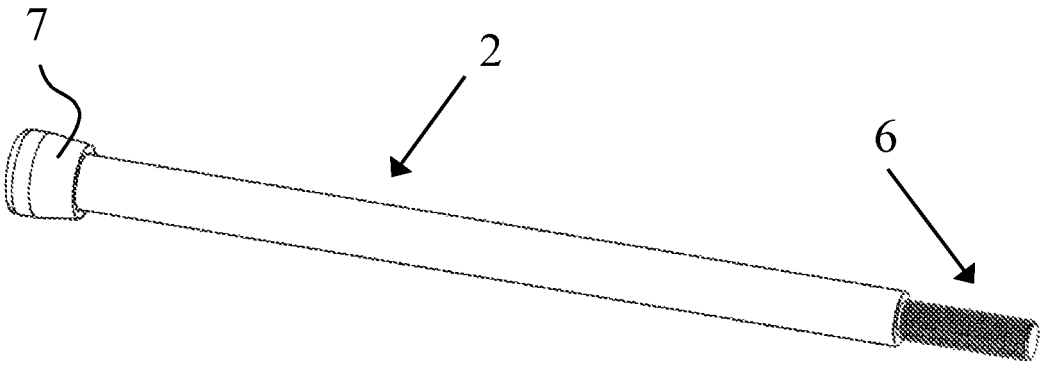
FIG. 2 is a perspective, isolated view of the extension bar.
Figure 3:
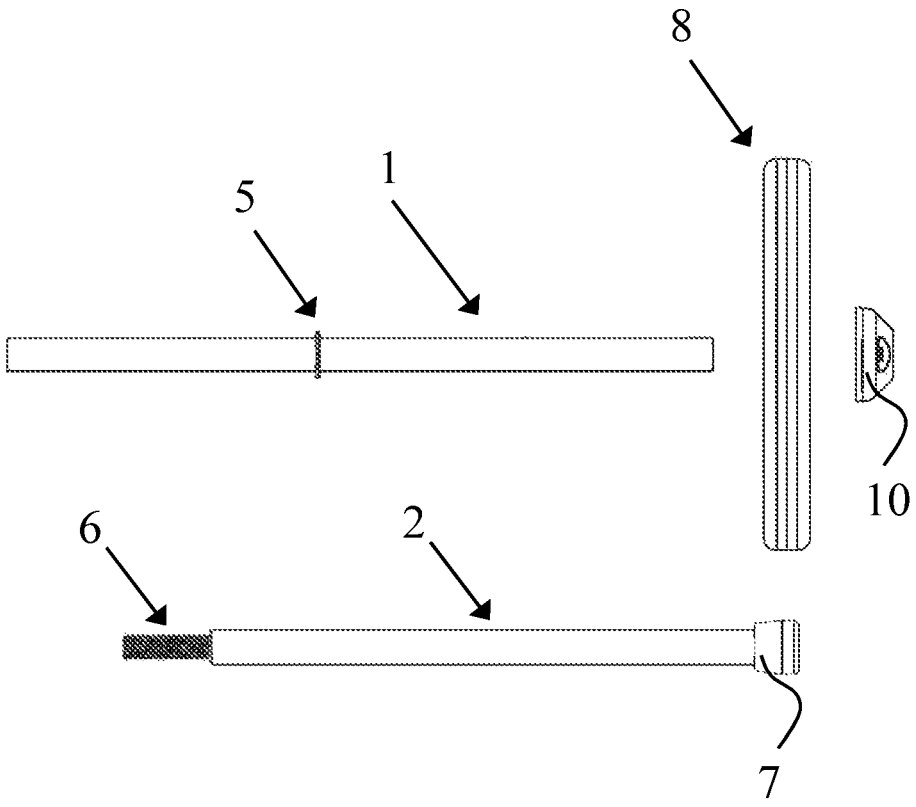
FIG. 3 depicts the manner of connecting the main bar to the extension bar to form an elongated weighted implement.
Figure 4:
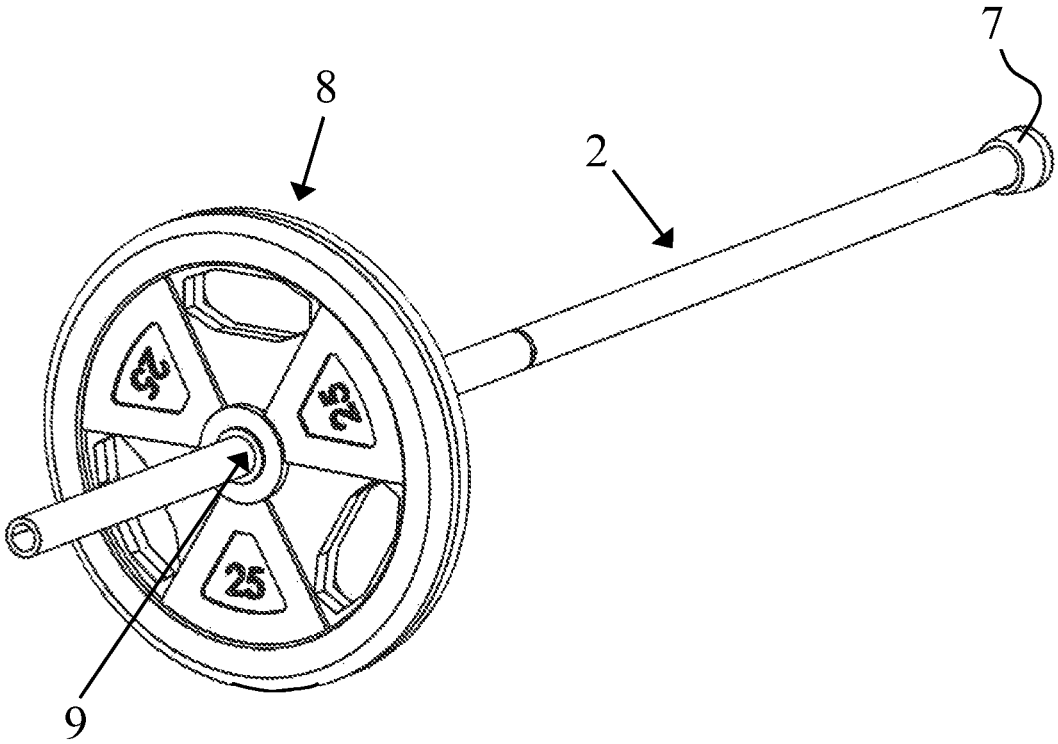
FIG. 4 depicts the main bar and extension bar of FIG. 3 properly connected.
Figure 5:
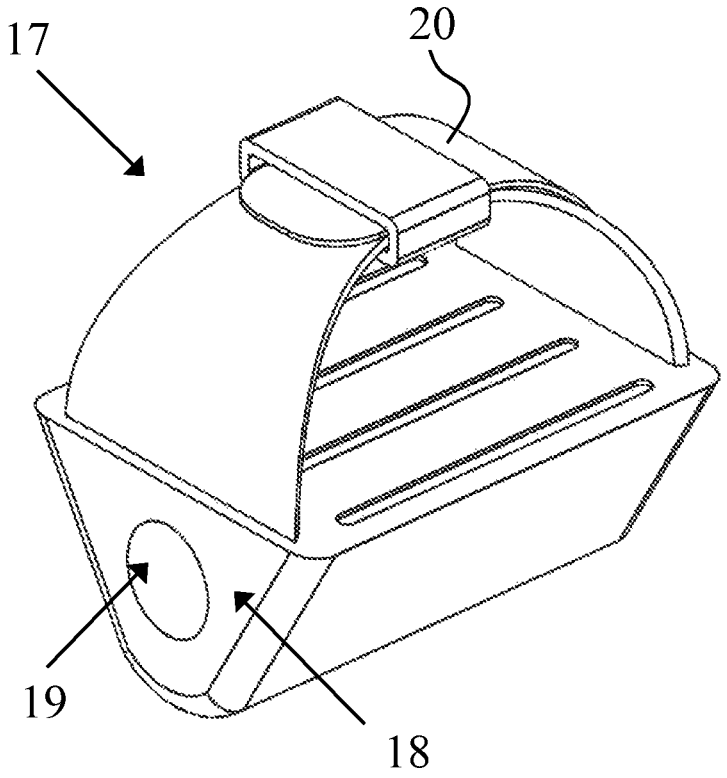
FIG. 5 is an isolated view of the foot attachment.
Figure 6:
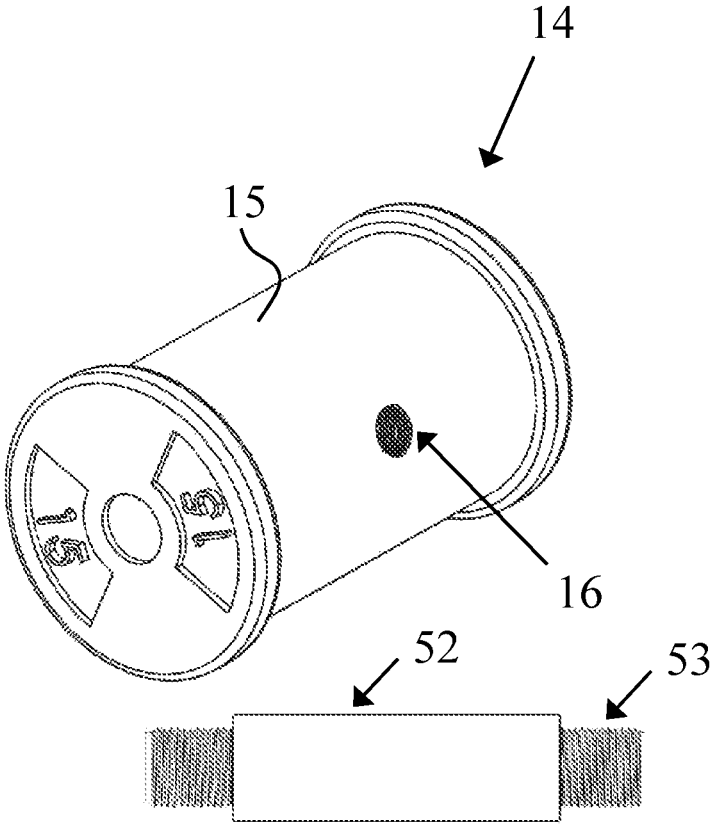
FIG. 6 is an isolated view of the hammer attachment and its corresponding adapter.
Figure 7:
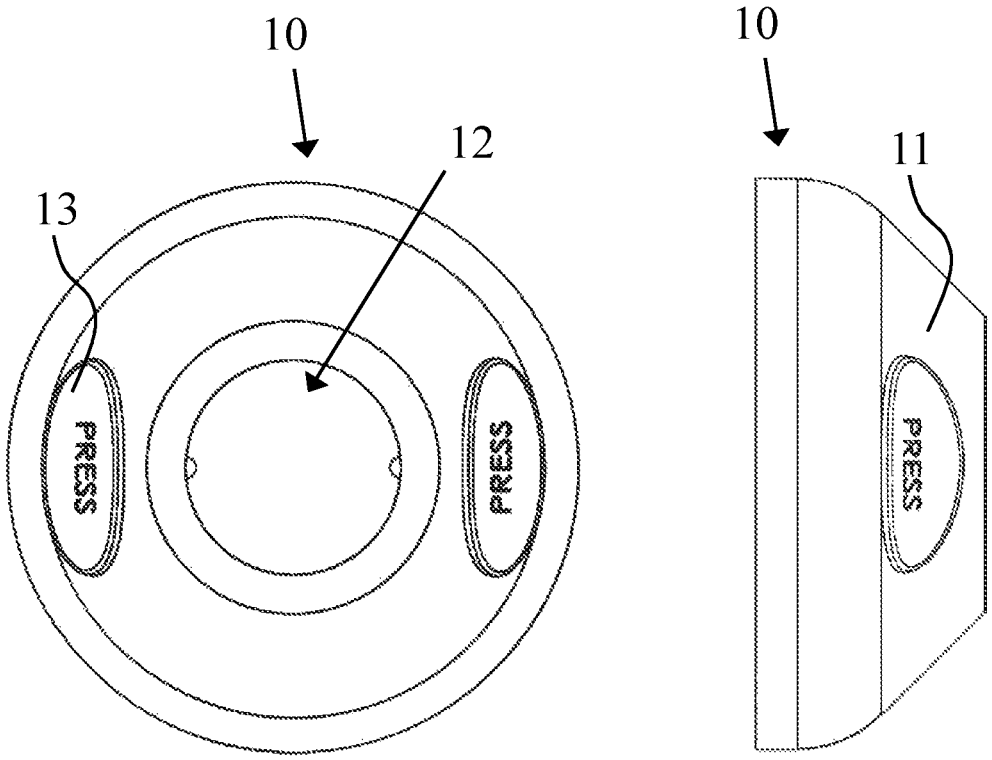
FIG. 7 is an isolated view of the spring-biased retaining clamps.
Figure 8:
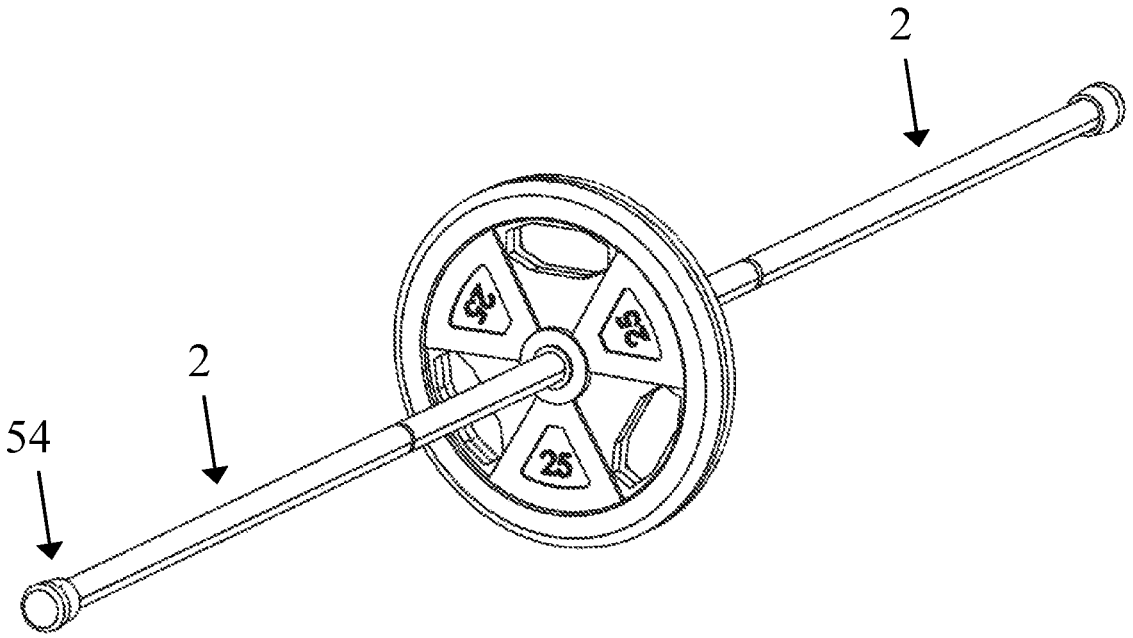
FIG. 8 depicts the main bar of FIG. 4 with a second extension bar attached thereto.

The present invention relates to a versatile weight bar assembly for performing a myriad of exercises including a shorter main bar 1 and a longer extension bar 2. The main bar is formed of an elongated tubular shaft 3 having a pair of opposing, internally threaded ends 4 and a central collar 5. The extension bar 2 includes an externally threaded post 6 at a first end that is configured to couple with either threaded end 4 of the main bar. At an opposing is a cap 7 that supports the bar on a floor or other surface when a user is performing certain exercises. The cap 7 covers an internally threaded end 54 for coupling additional attachments as described, infra. For example, as depicted in FIG. 8, a second extension bar can be secured to the main bar to allow a user to perform various exercises with a wider grip.

One or more weight discs 8 are securable to the main bar, on either side of the central collar. The disc has a central aperture 9 that receives either the main bar or extension bar depending upon an exercise being performed. Retaining clamps 10 can be secured to either bar to retain the weighted disc thereon during a given exercise. Each clamp includes a cup-shaped housing 11 having a central aperture 12 for receiving either bar. Spring-biased gripping members extend into the central aperture for releasably engaging the outer circumference of either bar. Depressing a button 13 retracts the gripping members to allow the clamp to be attached or removed.

Figure 9:
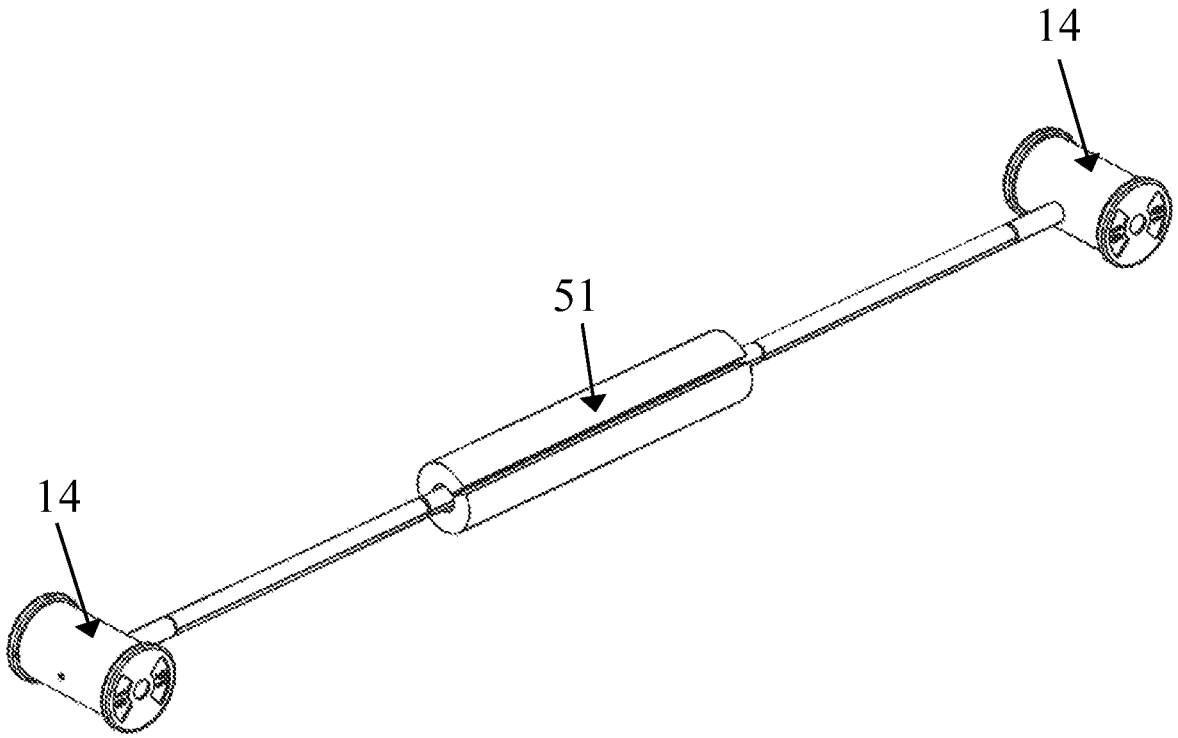
FIG. 9 depicts the device of FIG. 8 with a hammer attachment secured to the free end of each extension bar.

The weight assembly further includes various attachments that allow a user to perform additional exercises. For example, a hammer attachment 14 includes a weighted cylinder 15 having a central, threaded bore 16 for coupling with the threaded post on the extension bar. The hammer attachment allows a user to swing the extension bar like a sledge hammer or ax against a heavy bag or similar padded surface. As depicted in FIG. 9, the hammer attachment can be secured to the free end of each of two extension bars coupled with the main bar to allow a user to further vary a desired exercise regime. An attachable neck pad 51 allows the user to more comfortably perform an exercise when the bar is placed behind the neck. As such, an adapter 52 including two opposing threaded posts 53 couple the hammer attachment with the internally threaded end 54 of the extension bar.

Figure 10:
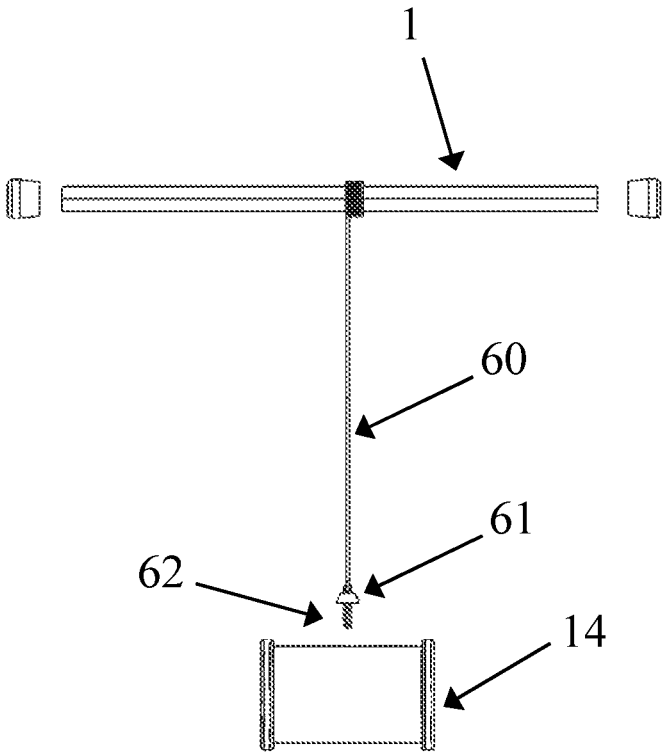
FIG. 10 depicts a means for attaching a rope to both the main bar and hammer attachment to allow a user to perform various forearm exercises.

Now referring to FIG. 10, a rope 60 having a plug 61 at its distal end may be spirally wrapped about the main bar. The plug includes a threaded post 62 that couples with the hammer-attachment bore 16 to form a wrist roller for strengthening the forearms.

A foot attachment 17 includes a sole portion 18 with a transverse bore 19 for receiving the main bar to allow the user to perform various leg exercises. A releasable strap 20 extends over the top surface of the attachment for securing to a user's foot. Accordingly the user can perform numerous exercises that involve suspending a weight using the leg and feet muscles.

The main bar and weight disc can be used independently to perform a myriad of resistance exercises similar to conventional dumbbells. In addition, the threaded post on the extension bar can be secured to either end of the main bar to allow a user to perform various exercises that require an elongated implement having a weighted end. Finally, a first extension bar can be secured to the main bar and the second extension bar can be secured to the opposing end of the first extension bar. Either end of the elongated bar can then be positioned within the corner of a room to allow a user to perform multiple exercises.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed:

1. A versatile weight bar assembly comprising:
- a main bar comprising
  - an elongated tubular shaft comprising
    - a first internally threaded end; and
    - a second internally threaded end opposite the first internally threaded end;
  - an extension bar comprising
    - an externally threaded post at a first end, the externally threaded post of the extension bar being coupled to the first internally threaded end of the main bar; and
  - a weight attached to the main bar or the extension bar;
  - wherein the extension bar is shorter than the main bar;
  - wherein the main bar further comprises a collar dividing the elongated tubular shaft into
    - a first exposed portion; and
    - a second exposed portion opposite the first exposed portion;
  - wherein the first exposed portion of the elongated tubular shaft is longer than the second exposed portion of the elongated tubular shaft.

2. The versatile weight bar assembly according to claim 1, wherein a diameter of the collar of the main bar is larger than a diameter of the elongated tubular shaft of the main bar.

3. The versatile weight bar assembly according to claim 2, wherein the weight is a hammer head attachment; and
- wherein the hammer head attachment comprises:
  - a weighted cylinder comprising a central, threaded bore for coupling with the externally threaded post of the extension bar.

4. The versatile weight bar assembly according to claim 1, wherein the weight is a foot attachment; and wherein the foot attachment comprises:
- a sole foot attachment;
- a strap attached to the sole foot attachment; and
- a transverse bore for receiving the main bar.

5. The versatile weight bar assembly according to claim 1 further comprising an adaptor; wherein the weight is a hammer head attachment; and wherein the adaptor comprises:
- two opposing threaded posts comprising
  - a first threaded post coupled with the hammer head attachment; and
  - a second threaded post coupled with an internally threaded second end of the extension bar.

6. The versatile weight bar assembly according to claim 1, wherein the weight is a slidable weight disc directly attached to the main bar by a clamp.

7. The versatile weight bar assembly according to claim 6, wherein the clamp comprises
- a cup-shaped housing comprising a central aperture;
- a pair of spring-biased gripping members extending into the central aperture; and
- a pair of buttons operatively to retract the pair of spring-biased gripping members.

8. The versatile weight bar assembly according to claim 7 further comprising an additional extension bar;
- wherein a first end of the pair of internally threaded ends of the elongated tubular shaft of the main bar is directly attached to the extension bar; and
- wherein a second end of the pair of internally threaded ends of the elongated tubular shaft of the main bar is directly attached to the additional extension bar.

9. The versatile weight bar assembly according to claim 1, wherein the weight is attached to the extension bar.

* * * * *